US007682461B2

(12) United States Patent
Sommer et al.

(10) Patent No.: US 7,682,461 B2
(45) Date of Patent: Mar. 23, 2010

(54) WORKING METHOD AND CLEANING DEVICE TO CLEAN A SWIMMING POOL

(75) Inventors: Hans Rudolf Sommer, Villnachern (CH); Peter Sommer, Schinznach-Dorf (CH)

(73) Assignee: 3S Systemtechnik AG, Remigen (CH)

( * ) Notice: Subject to any disclaimer, the term of this patent is extended or adjusted under 35 U.S.C. 154(b) by 343 days.

(21) Appl. No.: 11/677,081

(22) Filed: Feb. 21, 2007

(65) Prior Publication Data

US 2007/0199870 A1 Aug. 30, 2007

(30) Foreign Application Priority Data

Feb. 24, 2006 (CH) ..... 0295/06

(51) Int. Cl.
*B08B 7/04* (2006.01)

(52) U.S. Cl. ..... 134/18; 134/42

(58) Field of Classification Search ..... None
See application file for complete search history.

(56) References Cited

U.S. PATENT DOCUMENTS 2,988,762 A 6/1961 Babcock
6,309,468 B1 * 10/2001 Sommer ..... 134/18

FOREIGN PATENT DOCUMENTS

EP 0257006 A2 2/1988
EP 0989256 A1 3/2000
EP 1041220 A2 10/2000
WO 2005/045162 A1 5/2005

OTHER PUBLICATIONS

International Search Report, dated Nov. 27, 2006.

* cited by examiner

*Primary Examiner*—Michael Kornakov
*Assistant Examiner*—Ryan Coleman
(74) *Attorney, Agent, or Firm*—Pearne & Gordon LLP

(57) ABSTRACT

In a working method for a cleaning device (2) that moves back and forth in a swimming pool (1), control thereof is such that the cleaning device (2) moves from a starting position at a low speed in a forward direction V in a first pass in a first cleaning path (4) until it runs up to a pool wall (3), wherein the distance D1 traversed along the first cleaning path is measured or determined, the cleaning device (2) is then guided to a second cleaning path (5) deviating from or offset relative to the first cleaning path (4) in a second pass, initially at a low speed, whereupon the cleaning device then moves in a backward direction along the second cleaning path (5) at a high speed until the distance Dz traversed is smaller than the distance D1 traversed in the previous pass by an amount A, upon reaching distance Dz the cleaning device (2) continues to move along the second cleaning path (5) at low speed until it runs up to a swimming pool wall (3), wherein the distance D2 traversed along the second cleaning path is measured or determined, and the cleaning device (2) is controlled in the same manner in each subsequent pass as in the previous pass.

32 Claims, 2 Drawing Sheets

WORKING METHOD AND CLEANING DEVICE TO CLEAN A SWIMMING POOL

FIELD OF THE INVENTION

The invention relates to a working method for a cleaning device according to patent claim 1 that moves back and forth in a swimming pool and to a cleaning device according to patent claim 9 to carry out the working method.

BACKGROUND OF THE INVENTION

In particular, the invention relates to a cleaning device that moves back and forth in a swimming pool, said cleaning device having a drive mechanism that can be switched to forward or backward travel and that is actively connected to drive wheels or drive tracks, with a motor being provided for each of a left-hand side and a right-hand side part of the drive mechanism, respectively. Also provided is a control apparatus to control the drive mechanism, and contact means arranged at the front and rear to generate control signals in the event that the cleaning device runs up to a swimming pool wall or an obstacle. In addition, the control apparatus includes a speed control unit for each part of the drive mechanism, i.e. for each of the two motors, and means to differentially control the speed of both motors. Furthermore, the cleaning device has means at both parts of the drive mechanism to measure the distances traversed during travel. An example of such a cleaning device has been disclosed in EP-0 989 256. Cleaning devices of this type can be used in swimming pools of a wide diversity of shapes since, due to their design and the working method implemented, they do not require a reference swimming pool wall for alignment.

Differential speed control to control the two motors during travel has been implemented in EP-0 989 256 such that they are operated at different constant rotation rates at least part of the time, which is to say during the changes in direction to be carried out, in order to thereby accomplish controlled angular changes in direction. In the process, the angular change in direction desired can be determined by the difference in rotation rates since the path traversed is measured at both parts of the drive mechanism, and thus the different arc lengths are known. Although ramp functions for speed development are provided for the start phases, the changes in direction are essentially done at the speed of travel used to clean the swimming pool.

However, it has been found that in swimming pool cleaning devices of this type, gradually increasing deviations from the direction of motion (path direction) originally established nevertheless very often occur. This can be the case for larger swimming pools in particular, for example 50-m pools, which require a large number of cleaning passes. Investigations have shown that each time the cleaning devices run up to an edge of the swimming pool or an obstacle, the jolt caused by abrupt braking or impact usually causes a backward displacement or a rotation, albeit only slightly. As the number of abrupt braking motions increases, these path errors accumulate. For the most part, mechanical devices continue to be used as contacting means since other sensors, such as those that are optics based, rapidly fail or provide unreliable results especially in turbid water. Frequently, it is additionally also the case that the deflection length of the mechanical switching element is too small relative to the required braking distance of the cleaning device, so that the offsets that occur upon impact are further amplified as a result of the inertia of the cleaning device.

BRIEF SUMMARY OF THE INVENTION

The object of this invention is to provide a working method for a swimming pool cleaning device of this type that allows for further improvement in the precision with which the cleaning paths are maintained (motion pattern stability), and thus further improves the quality and reliability of the swimming pool cleaning process. The working method is intended to be equally suitable both for large rectangular swimming pools as well as for swimming pools of an irregular shape.

This object is achieved by the features in the characterizing portion of independent method claim 1 and the features in independent device claim 9.

The working method according to the invention comprises controlling a cleaning device of this type using a control apparatus of the cleaning device in such a way that the cleaning device moves at a low speed in a forward direction V in a first cleaning pass in a first cleaning path from a starting position until it runs up to a pool wall, whereby the distance D1 traversed along the first cleaning path is measured or determined, the cleaning device is then guided to a second cleaning path deviating from or offset relative to the first cleaning path in a second cleaning pass, initially at a low speed, whereupon the cleaning device then moves in a backward direction along the second cleaning path at a high speed until the distance Dz traversed is smaller than the distance D1 traversed in the previous pass by an amount A, lastly, upon reaching distance Dz the cleaning device continues to move along the second cleaning path at low speed until it runs up to a swimming pool wall, wherein the distance D2 traversed along the second cleaning path is measured or determined, and the cleaning device is controlled in the same manner in each subsequent pass as in the previous pass.

The cleaning device according to the invention which carries out the working method described above comprises that the motors of the control apparatus in a cleaning device of the above type can be operated at least one low speed and at least one high speed.

By switching from a high motion speed to a low motion speed when nearing a swimming pool wall, positional errors are considerably reduced, in particular cumulative positional errors that occur after a number of runs up to a swimming pool wall. With regard to the nearing of a swimming pool wall, it is assumed that the distance traveled along each subsequent, adjacent cleaning path can in general not be much different than the respective previous distance traveled, even in irregularly shaped swimming pools; therefore, it is sufficient to reduce the speed upon registering a distance traversed that is less than that traversed in the previous pass by a distance A. In practice, good results have been achieved at speeds of 0.2 to 0.25 m/s and distance A of 0.5 m with regard to improving the precision in maintaining the cleaning paths.

Thus, except for edge areas near the swimming pool walls, higher cleaning speeds can be maintained along the entire surface area of the bottom of the swimming pool. This accomplishes shorter cleaning times and therefore energy savings. At the same time, a more stable motion pattern is achieved and thus a better and more reliable cleaning result.

Practical improvements occur especially if the low speed of the cleaning device near the edge area of the swimming pool is adjusted such that the braking distance of the cleaning device at low speed is less than the deflection length E of the mechanical switching element (contact means) used. This allows the mass of the cleaning device to be brought to a standstill in a controlled manner. In this way, runs up to the swimming pool walls do not cause a deterioration of the motion pattern.

Another alternative is, of course, to use non-contact sensors that can be used alone or in addition to mechanical contact means. In order to achieve a controlled stop of the cleaning device in this case as well, non-contact sensors must possess an actuation distance A that is larger than the braking distance of the cleaning device at low speed. However, since the actuation effectiveness and thus the actuation distance of non-contact sensors, in particular optical sensors, depends enormously on factors such as water quality in the swimming pool, the color or texture of the walls of the swimming pool and on the relative alignment of the sensors to the swimming pool wall, there remains a relatively large actuation imprecision here in general, which is why sole use of these sensors is often problematic. Non-contact sensors that are reliable in all water qualities could, however, ideally solve the problem of controlled stopping. Further improvements to and extensions of the working method according to the invention can be achieved by expanding the differential speed control options of the two motors. Whereas in EP-0 989 256 turning motion is achieved simply by different speeds of the motors of both parts of the driving mechanisms, the speeds being relatively high and acting in the same direction, it is also possible to operate the two motors at equal speeds but in opposite directions. This permits rotation on the spot, and thus changes in direction in the smallest possible space. As a result, this enables the implementation of new and more efficient cleaning patterns. The number of partial methods provided to guide the cleaning device to a cleaning path that deviates from or is offset relative to the previous cleaning path can therefore be expanded.

One of these partial methods can comprise guiding the cleaning device to a cleaning path that runs at a slant relative to the previous cleaning path, similar to the method of EP-0 989 256. This can cause a rather large overlap of the individual cleaning paths and thus an increased cleaning effect, although with a concomitant increase in the overall path length to be traversed to clean the entire swimming pool.

Another possible partial method can comprise guiding the cleaning device to a cleaning path that runs substantially parallel to the previous cleaning path. This substantially eliminates overlap, and the overall path length to be traversed to clean the entire swimming pool, and thus the cleaning time, can be kept to a minimum. In particular, the additional use of a referencing directional element in applications of such partial methods, such as a compass, would doubtless provide another contribution to the maintenance of a stable motion pattern. However, experience has shown that the use of reliable referencing directional elements is very expensive, which is why they are avoided if possible. The working method according to the invention offers the possibility of executing cleaning patterns having parallel cleaning paths with a satisfactory pattern stability even if the pool is very large.

By providing different such "motion pattern programs" in total, the flexibility of the working method can be considerably expanded and optimally tailored to existing situations.

BRIEF DESCRIPTION OF THE SEVERAL VIEWS OF THE DRAWINGS

In the following, the working method according to the invention is described in detail on the basis of two examples.

Shown in the drawings are:

FIG. 1 shows in schematic fashion a first partial method for a working method according to the invention to clean a rectangular swimming pool 1, said partial method having cleaning paths that run at a slant.

DETAILED DESCRIPTION OF THE INVENTION

Figure 1:
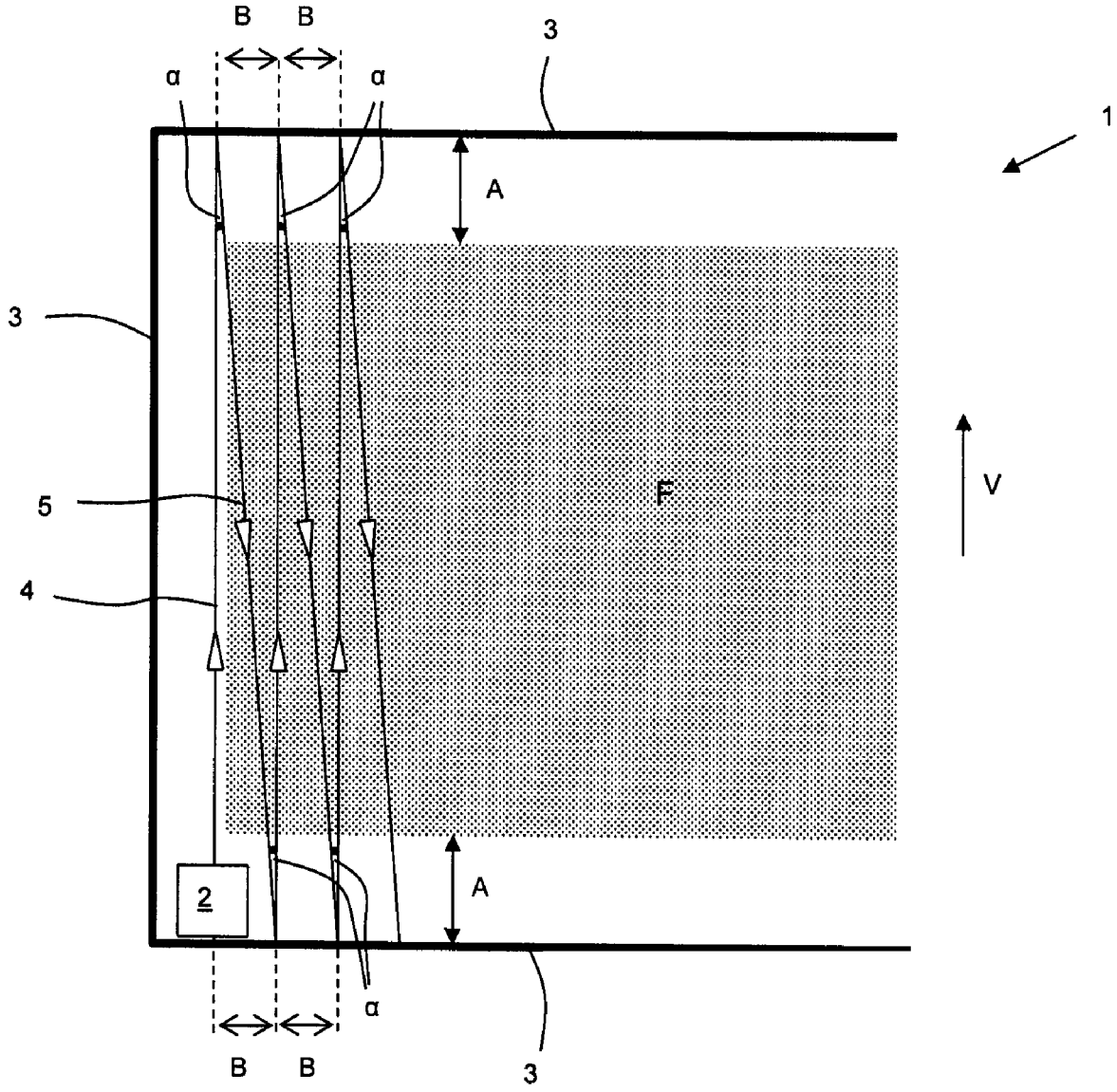
FIG. 1 a first partial method with cleaning paths that run at a slant.

To begin with, a cleaning device 2 that moves back and forth in the swimming pool 1 is placed in a start position in a corner at a swimming pool wall 3. The cleaning device 2 is directed such that when it is released it moves in a forward direction V in a first cleaning path 4 parallel to a swimming pool wall 3.

The cleaning device 2 has a drive mechanism that can be switched to forward or backward travel and is actively connected to drive wheels or drive tracks, with a motor being provided for each of a left-hand side and a right-hand side part of the drive mechanism, respectively, a control apparatus to control the drive mechanism, and contact means arranged at the front and rear to generate control signals in the event that the cleaning device runs up to a swimming pool wall 3 or an obstacle. The control apparatus has a speed control device for each part of the drive mechanism as well as means for differential control of the speed of the two motors in the respective parts of the drive mechanism. Furthermore, the cleaning device 2 has means at both parts of the drive mechanism to measure the distances traversed during travel.

The control apparatus controls the cleaning device 2 in such a manner that in a first pass it moves straight from the start position at a low speed in the first cleaning path 4 in the forward direction V until it runs up to an opposite swimming pool wall 3. In the process, the distance D1 traversed along the first cleaning path 4 is measured or determined. The low speed is used because the control apparatus has no information yet concerning the estimated distance to be traversed up to the opposite pool wall during this phase, and in this way will avoid too hard an impact. When the opposite pool wall is reached, or when an obstacle is encountered, the cleaning device 2 is stopped and the direction of motion is reversed.

In a second pass, the cleaning device 2 is first guided at low speed to a second cleaning path 5 deviating from or offset relative to the first cleaning path 4. In the present example, the second cleaning path 5 runs at a slant relative to the previous first cleaning path 4. The redirection to the second cleaning path 5 is accomplished through differential speed control of the motors of the two parts of the drive mechanism. The turning motion to accomplish a deviation in course $\alpha$ can be controlled by prescribing different speed setpoints in the two motors and by using different distances (arc lengths) measured at the respective parts of the drive mechanism and traversed during travel. An example of such a control device has been described in detail in EP-0 989 256. The cleaning device 2 then moves along the second cleaning path 5 at a high speed in a reverse direction until the distance Dz traversed is smaller by a distance A than the distance D1 traversed in the previous pass. It is assumed that the distance traversed along an adjacent cleaning path cannot be much different from a distance traversed immediately previous to it, even in the case of irregularly shaped swimming pools, and that it is therefore sufficient to only reduce speed again after registering a distance that is shorter than the distance traversed in the previous pass by a distance A.

When distance Dz is reached, the cleaning device 2 continues to move at a slow speed along the second cleaning path 5 until it runs up to the swimming pool wall 3. Thus the cleaning device also runs up to the swimming pool wall in a controlled manner at a low speed in this case. The distance D2 traversed along the second cleaning path 5 is also measured or determined.

The cleaning device 2 is controlled in the same manner in each subsequent pass as in the previous pass. Based on the distance traversed in the previous pass, a course deviation angle is calculated that each time enables the device to reach the opposite swimming pool wall 3 at a point that is substantially situated next to the (respective) previous point of reversal with an offset width B. In the present example of a rectangularly shaped swimming pool, one would naturally expect that the course deviation angle, in this case the course deviation $\alpha$ calculated each time, will always be approximately the same.

Thus, this method always enables the (shaded) central portion F (predominating in terms of area) of the swimming pool to be cleaned efficiently and at a high speed. Conversely, motion control of the cleaning device 2 near the edge areas of the swimming pool walls 3 is always done at a low speed, which considerably increases the motion pattern stability.

Figure 2:
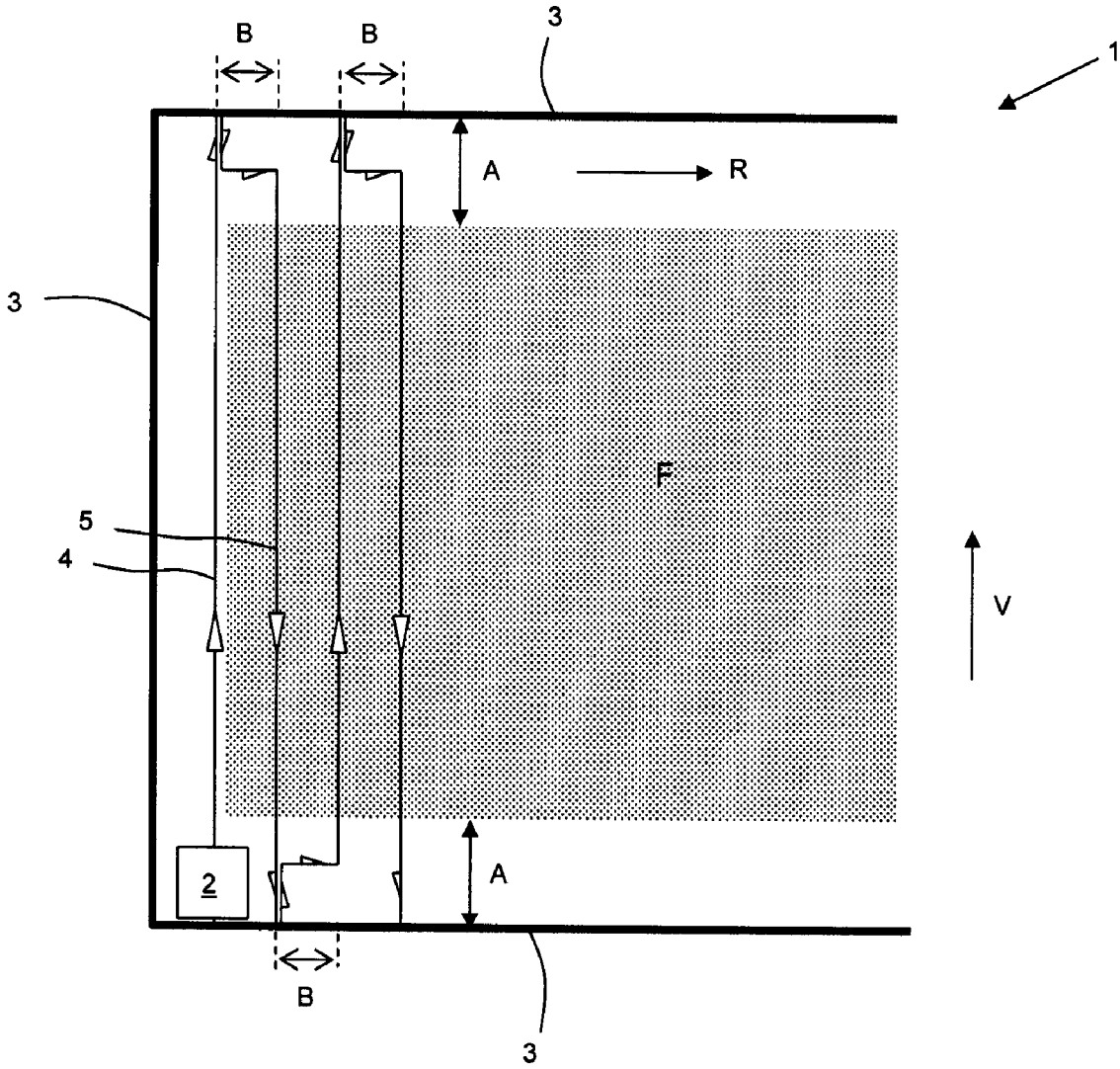
FIG. 2 a second partial method with parallel cleaning paths.

FIG. 2 shows in schematic fashion a second partial method for a working method according to the invention to clean a rectangular swimming pool 1, said partial method having parallel cleaning paths.

To begin with, the cleaning device 2 that moves back and forth in the swimming pool 1 is placed in a start position in a corner at a swimming pool wall 3. The cleaning device 2 is directed such that when it is released it moves in a forward direction V in a first cleaning path 4 parallel to the swimming pool wall 3.

The control apparatus again controls the cleaning device 2 in such a manner that in a first pass it moves straight from the start position at a low speed in the first cleaning path 4 in the forward direction V until it runs up to the opposite swimming pool wall 3. In the process, the distance D1 traversed along the first cleaning path 4 is measured or determined. The low speed is used because the control apparatus has no information yet concerning the estimated distance to be traversed up to the opposite pool wall during this phase, and in this way too hard an impact can be avoided. When the opposite pool wall is reached, or when an obstacle is encountered, the cleaning device 2 is stopped and the direction of motion is reversed.

In a second pass, the cleaning device 2 is first guided at low speed to a second cleaning path 5 deviating from or offset relative to the first cleaning path 4. In this example, the second cleaning path 5 runs parallel to the previous first cleaning path 4. The redirection to the second cleaning path 5 is accomplished through a combination of motions, including a "rotation on the spot", which can be seen as a special case or an extension of the differential speed control of the motors of the two parts of the drive mechanism.

In the case at hand, the cleaning device 2 first backs away somewhat from the swimming pool wall 3 at low speed, normally just far enough to enable a leftward rotation on the spot by 90° counterclockwise (as seen from above) without being hindered in doing so. To make this on-the-spot rotation, the motors of the two parts of the drive mechanism are operated at equal but opposite speeds. Then, the cleaning device moves in the lateral direction R by offset width B in order to finally complete the redirection procedure with a right turn on the spot by 90° clockwise (as seen from above). Of course, it is not necessary to make the left and right rotations by exactly 90°, other angles can also be selected. However, the two rotation angles should be equal but opposite, or the durations of rotation should be of equal length. In addition, a re-alignment procedure (not shown) can also be added before continuing motion or before the next swimming pool traverse is begun, in particular for rectangular swimming pools.

The cleaning device 2 then moves along the second cleaning path 5 at a high speed in the reverse direction until the distance Dz traversed is smaller by a distance A than the distance D1 traversed in the previous pass. It is again assumed that the distance traversed along an adjacent cleaning path cannot be much different from a distance traversed immediately previous to it, even in the case of irregularly shaped swimming pools, and that it is therefore sufficient to only reduce speed again after registering a distance that is shorter than the distance traversed in the previous pass by a distance A.

When distance Dz is reached, the cleaning device 2 continues to move at a slow speed along the second cleaning path 5 until it runs up to the swimming pool wall 3. Thus, also in this case the cleaning device runs up to the swimming pool wall in a controlled manner at a low speed. The distance D2 traversed along the second cleaning path 5 is also measured or determined.

In each subsequent pass, the cleaning device 2 is controlled in the same manner as in the previous pass, respectively.

Thus, this partial method always enables the (shaded) central portion F (predominantly in terms of area) of the swimming pool to be cleaned efficiently and at a high speed. Because the cleaning paths in area F overlap only minimally or not at all, area F can even be cleaned very rapidly in comparison to the first partial method described above. Conversely, in this case as well motion control of the cleaning device 2 near the edge areas of the swimming pool walls 3 is always done at a low speed, which considerably increases the motion pattern stability.

In conclusion, the measure according to the invention comprising that the device always moves at a low speed in the edge area of swimming pools, allows for high cleaning speeds with more stable motion patterns in the central area F of swimming pools. The reason for this is that (because of this decoupling process) the selection of cleaning speed in the central area F no longer has to represent a compromise which guarantees reasonably stable motion patterns also during 'predictable' runs up to the swimming pool edges.

As illustrated with the two partial methods (according to FIGS. 1 and 2), the cleaning speed in the central area F of the swimming pool can be increased even further, and/or the cleaning process can be further optimized either with respect to the cleaning speed or the thoroughness of cleaning, by suitably selecting the actual partial method for cleaning.

Moreover, the flexibility of the software used to control the cleaning device 2 also naturally allows the cleaning device 2 to be operated in the forward or backward direction beginning from the start position for the pass along the first cleaning path, since the control processes are symmetric in the forward direction V and in the backward direction as shown in the two exemplary partial methods described above. And, of course, the flexibility of the software also enables the cleaning device to be started from any corner of a rectangular swimming pool.

PARTS LIST

1 Swimming pool
2 Cleaning device
3 Swimming pool wall
4 First cleaning path
5 Second cleaning path
V Forward direction
α Course deviation
A Distance
F Central area
B Offset width
R Lateral direction

The invention claimed is:

1. A working method for a cleaning device (2) that moves back and forth in a swimming pool (1), with a drive mechanism that can be switched to forward or backward travel and that is actively connected to drive wheels or drive tracks, with a motor being provided for each of a left-hand side and a right-hand side part of the drive mechanism, respectively, and with a control apparatus to control the drive mechanism, and contact means arranged at the front and rear to generate control signals in the event that the cleaning device (2) runs up to a swimming pool wall (3) or an obstacle, wherein the control apparatus comprises a speed control unit for each part of the drive mechanism and means to differentially control the speed of both of the motors, and wherein the cleaning device comprises means at both parts of the drive mechanism to measure the distances traversed during travel, characterized in that the control apparatus controls the cleaning device (2) in such a way that the cleaning device (2) moves at a low speed in a forward direction V in a first pass in a first cleaning path (4) from a starting position until it runs up to a pool wall (3), wherein the distance D1 traversed along the first cleaning path is measured or determined, the cleaning device (2) is then initially guided at a low speed to a second cleaning path (5) deviating from or offset relative to the first cleaning path (4) whereupon in a second pass the cleaning device moves in a backward direction along the second cleaning path (5) at a high speed until the distance Dz traversed is smaller by an amount A than the distance D1 traversed in the previous pass, upon reaching distance Dz the cleaning device (2) continues to move along the second cleaning path (5) at low speed until it runs up to a swimming pool wall (3), wherein the distance D2 traversed along the second cleaning path is measured or determined, and the cleaning device (2) is controlled in the same manner in each subsequent pass as in the previous pass.

2. The working method according to claim 1, characterized in that the contact means are deflecting mechanical switching elements with a deflection length E, and the braking distance of the cleaning device (2) at low speed is less than the deflection length B.

3. The working method according to claim 1, characterized in that the contact means are non-contact sensors with an actuation distance A, and the braking distance of the cleaning device (2) at low speed is less than the actuation distance A.

4. The working method according to claim 1, characterized in that different types of contact means are used at the same time to raise the operational reliability.

5. The working method according to claim 1, characterized in that the differential control of the speed of the two motors permits both differing speeds as well as differing directions of rotation, wherein the latter also enables rotation on the spot by means of equal but opposite speeds.

6. The working method according to claim 1, characterized in that the cleaning device (2) is guided to a cleaning path, that deviates from or is offset relative to a previous cleaning path, by means of the differential control of the speed of the two motors using at least one of a number of available partial methods.

7. The working method according to claim 6, characterized in that in a first partial method the cleaning device (2) is guided to a cleaning path that is at a slant relative to the previous cleaning path.

8. The working method according to claim 6, characterized in that in a second partial method the cleaning device (2) is guided to a cleaning path that is essentially parallel to the previous cleaning path.

9. The working method according to claim 2, characterized in that the differential control of the speed of the two motors permits both differing speeds as well as differing directions of rotation, wherein the latter also enables rotation on the spot by means of equal but opposite speeds.

10. The working method according to claim 3, characterized in that the differential control of the speed of the two motors permits both differing speeds as well as differing directions of rotation, wherein the latter also enables rotation on the spot by means of equal but opposite speeds.

11. The working method according to claim 4, characterized in that the differential control of the speed of the two motors permits both differing speeds as well as differing directions of rotation, wherein the latter also enables rotation on the spot by means of equal but opposite speeds.

12. The working method according to claim 2, characterized in that the cleaning device (2) is guided to a cleaning path, that deviates from or is offset relative to a previous cleaning path, by means of the differential control of the speed of the two motors using at least one of a number of available partial methods.

13. The working method according to claim 3, characterized in that the cleaning device (2) is guided to a cleaning path, that deviates from or is offset relative to a previous cleaning path, by means of the differential control of the speed of the two motors using at least one of a number of available partial methods.

14. The working method according to claim 4, characterized in that the cleaning device (2) is guided to a cleaning path, that deviates from or is offset relative to a previous cleaning path, by means of the differential control of the speed of the two motors using at least one of a number of available partial methods.

15. The working method according to claim 5, characterized in that the cleaning device (2) is guided to a cleaning path, that deviates from or is offset relative to a previous cleaning path, by means of the differential control of the speed of the two motors using at least one of a number of available partial methods.

16. The working method according to claim 9, characterized in that the cleaning device (2) is guided to a cleaning path, that deviates from or is offset relative to a previous cleaning path, by means of the differential control of the speed of the two motors using at least one of a number of available partial methods.

17. The working method according to claim 10, characterized in that the cleaning device (2) is guided to a cleaning path, that deviates from or is offset relative to a previous cleaning path, by means of the differential control of the speed of the two motors using at least one of a number of available partial methods.

18. The working method according to claim 11, characterized in that the cleaning device (2) is guided to a cleaning path, that deviates from or is offset relative to a previous cleaning path, by means of the differential control of the speed of the two motors using at least one of a number of available partial methods.

19. The working method according to claim 12, characterized in that in a first partial method the cleaning device (2) is guided to a cleaning path that is at a slant relative to the previous cleaning path.

20. The working method according to claim 13, characterized in that in a first partial method the cleaning device (2) is guided to a cleaning path that is at a slant relative to the previous cleaning path.

21. The working method according to claim 14, characterized in that in a first partial method the cleaning device (2) is guided to a cleaning path that is at a slant relative to the previous cleaning path.

22. The working method according to claim 15, characterized in that in a first partial method the cleaning device (2) is guided to a cleaning path that is at a slant relative to the previous cleaning path.

23. The working method according to claim 16, characterized in that in a first partial method the cleaning device (2) is guided to a cleaning path that is at a slant relative to the previous cleaning path.

24. The working method according to claim 17, characterized in that in a first partial method the cleaning device (2) is guided to a cleaning path that is at a slant relative to the previous cleaning path.

25. The working method according to claim 18, characterized in that in a first partial method the cleaning device (2) is guided to a cleaning path that is at a slant relative to the previous cleaning path.

26. The working method according to claim 12, characterized in that in a second partial method the cleaning device (2) is guided to a cleaning path that is essentially parallel to the previous cleaning path.

27. The working method according to claim 13, characterized in that in a second partial method the cleaning device (2) is guided to a cleaning path that is essentially parallel to the previous cleaning path.

28. The working method according to claim 14, characterized in that in a second partial method the cleaning device (2) is guided to a cleaning path that is essentially parallel to the previous cleaning path.

29. The working method according to claim 15, characterized in that in a second partial method the cleaning device (2) is guided to a cleaning path that is essentially parallel to the previous cleaning path.

30. The working method according to claim 16, characterized in that in a second partial method the cleaning device (2) is guided to a cleaning path that is essentially parallel to the previous cleaning path.

31. The working method according to claim 17, characterized in that in a second partial method the cleaning device (2) is guided to a cleaning path that is essentially parallel to the previous cleaning path.

32. The working method according to claim 18, characterized in that in a second partial method the cleaning device (2) is guided to a cleaning path that is essentially parallel to the previous cleaning path.

* * * * *

UNITED STATES PATENT AND TRADEMARK OFFICE

CERTIFICATE OF CORRECTION

PATENT NO. : 7,682,461 B2
APPLICATION NO. : 11/677081
DATED : March 23, 2010
INVENTOR(S) : Hans Rudolf Sommer and Peter Sommer It is certified that error appears in the above-identified patent and that said Letters Patent is hereby corrected as shown below:

In the claims: column 7, line 60 claim 2, please replace "B" with -- E --.

Signed and Sealed this

Seventeenth Day of August, 2010

David J. Kappos

David J. Kappos
*Director of the United States Patent and Trademark Office*